US005289224A

United States Patent [19]

Devaney, Jr. et al.

[11] Patent Number: 5,289,224

[45] Date of Patent: Feb. 22, 1994

[54] PROCESSING APPARATUS

[75] Inventors: Mark J. Devaney, Jr.; Lee F. Frank, both of Rochester, N.Y.

[73] Assignee: Eastman Kodak Company, Rochester, N.Y.

[21] Appl. No.: 884,576

[22] Filed: May 18, 1992

[51] Int. Cl.[5] ..... G03D 3/02; G03D 13/02

[52] U.S. Cl. ..... 354/324; 354/331; 354/336

[58] Field of Search ..... 354/319-324, 354/331, 336

[56] References Cited

U.S. PATENT DOCUMENTS

| | | | |
|---|---|---|---|
| 2,734,224 | 2/1956 | Winstead | 18/12 |
| 3,200,724 | 8/1965 | Stamm et al. | 95/12 |
| 3,372,630 | 3/1968 | Schmidt | 354/328 |
| 3,381,336 | 5/1968 | Wells | 18/8 |
| 3,405,627 | 10/1968 | Day et al. | 354/331 |
| 3,427,949 | 2/1969 | Knight et al. | 95/89 |
| 3,825,645 | 7/1974 | Fayet | 264/177 |
| 3,886,576 | 5/1975 | Stoffel | 354/317 |
| 4,994,840 | 2/1991 | Hall et al. | 354/324 |

*Primary Examiner*—D. Rutledge

*Attorney, Agent, or Firm*—Dana M. Schmidt

[57] ABSTRACT

Apparatus for treating a web with treatment fluid comprises a two part housing defining a recess for receiving the web and a fluid distribution system for supplying treatment fluid to the recess. The fluid distribution system comprises a series of passages connected in a whiffletree configuration for dividing and subdividing the treatment fluid to supply treatment fluid to the recess at a plurality of locations across the recess to uniformly treat the web with the treatment fluid. In another embodiment the processor comprises a pair of plates defining a recess for receiving a web. The plates have at least one pair of elongated liquid injection openings extending transversely of the recess on opposite sides of the web respectively in juxtaposed relationship for injecting liquid into the recess. The plates further include at least one pair of elongated evacuation openings extending transversely of the recess on opposite sides of the web respectively in juxtaposed relationship for evacuating liquid from the recess. A whiffletree liquid distribution system is associated with each of the openings to supply liquid to the injection openings and to evacuate liquid from the evacuation openings.

21 Claims, 7 Drawing Sheets

PROCESSING APPARATUS

CROSS REFERENCE TO RELATED APPLICATIONS

Reference is made to the following commonly assigned copending applications:

1. U.S. application Ser. No. 07/633,505 filed Dec. 28, 1990 by Lee F. Frank et al and entitled "Apparatus for Enhancing Heat and Mass Transfer in a Fluid Medium", and 2. U.S. application Ser. No. 07/633,521 filed Dec. 28, 1990 by Lee F. Frank et al and entitled "Processing Apparatus".

TECHNICAL FIELD

This invention relates to apparatus for subjecting web material to treatment and more particularly to apparatus for processing light sensitive material such as photographic film or paper.

BACKGROUND ART

In fluid supply systems for single sheet flow cell processors it is customary to provide fairly large tubes along the supply and drain sides of the flow cell to provide a center fed manifold flow distribution. When fluid enters the system it enters the supply manifold at the center and immediately begins spreading out through the adjacent small slit in to the cell. As the fluid works its way along the supply manifold, it spreads out through more of the slit, eventually completely filling the cell. Those areas of the flow cell furthest from the supply receive the incoming fluid last. Such a prior art cell and its fluid distribution pattern is depicted in FIG. 1 of the drawings.

The above described flow cell processor possesses a number of disadvantages. It is difficult to design, dependent on flow rates and fluid characteristics and does not achieve uniform processing due to variations in the fluid path length to various parts of the processor and variable pressures in the supply manifold. As indicated in FIG. 1 the path variations and/or variations in pressures within the supply manifold results in a generally arcuate fluid front resulting in increased processing in the center regions relative to the edge regions and differential lateral fluid flow.

Similar non-uniform fluid distribution can occur in parallel plate processors of the type disclosed in U.S. application Ser. Nos. 07/633,505 and 07/633,521 which are cross referenced above. In a parallel plate processor fluid is injected into a web processing channel through at least one elongated slit extending transversely of the channel. If fluid is supplied to the slit by a central circular opening then areas of the slit furthest from the central opening will receive fluid last and at slightly lower pressures. As a result the fluid entering the channel from the slit will have an arcuate flow pattern similar to that depicted in FIG. 1. Thus the fluid discharged from the slit will reach the central region of the web prior to the edge regions and flow at the center region will remain at a higher rate due to the higher pressure to produce non uniform processing.

DISCLOSURE OF THE INVENTION

In accordance with the invention processing fluid is applied to a sheet or elongated web of light sensitive material by an elongated passage extending transversely of the material. Fluid is supplied to the passage by a fluid distribution system comprising a plurality of passages connected in a whiffletree configuration to divide and subdivide the fluid flow in a system of branch passages. With this arrangement fluid is supplied substantially simultaneously to a plurality of locations of the elongated opening to thereby distribute fluid transversely of the material with uniform pressure and flow. Such distribution of the fluid results in substantially uniform processing of the material.

BRIEF DESCRIPTION OF THE DRAWINGS

Other objects and advantages will become apparent from the following description taken in connection with the accompanying drawings wherein.

MODE OF CARRYING OUT THE INVENTION

Figure 1:
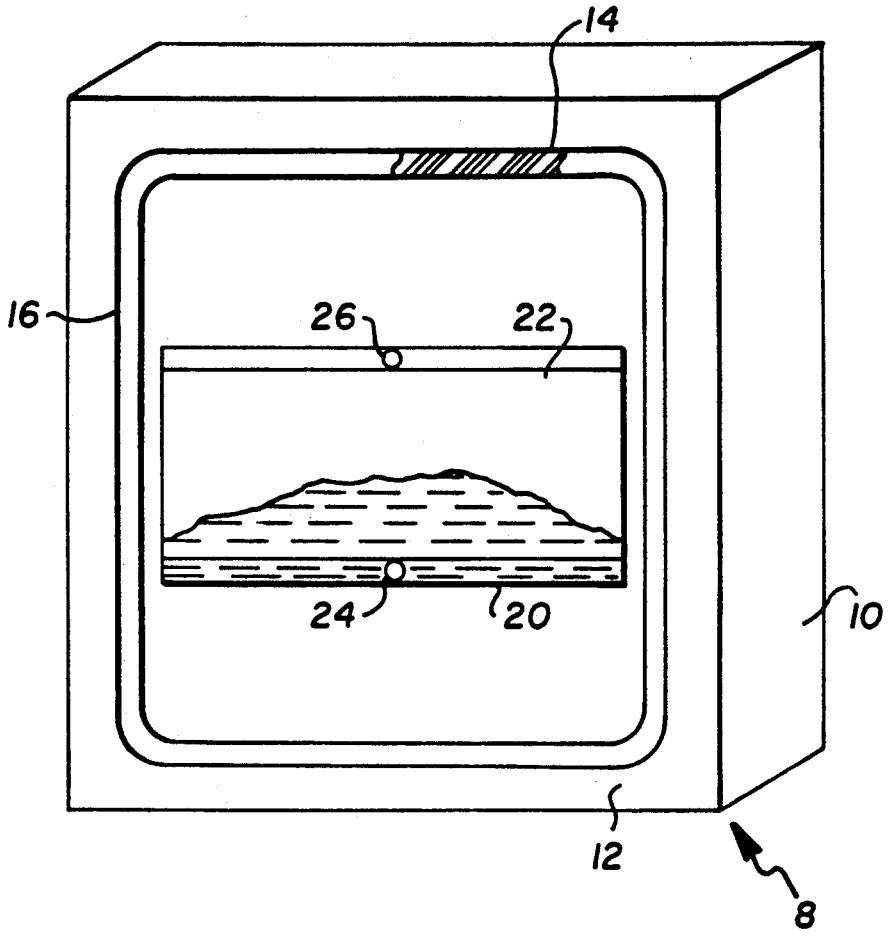
FIG. 1 is a schematic illustration of a prior art center fed cell processor for processing sheets of light sensitive material.

Referring to FIG. 1 of the drawings there is shown a prior art flow cell processor 8 comprising a generally rectangular housing 10 provided with a face surface 12 and having surface grooves which define the passages described below. An O-ring seal 14 is partially received in a groove 16 adjacent the periphery of the face surface 12. A cover plate (not shown) is adapted to be attached to the face surface 12 and has a flat surface for engaging the seal 14 to seal the housing and fluid passages in the face surface.

The processor shown in FIG. 1 includes a rectangular recess 20 in face surface 12 for receiving a web or sheet 22 of light sensitive material such as photographic film or paper. Processing solution is injected into the recess 20 through a circular opening 24 adjacent the lower edge of the recess 20 and evacuated from the recess 20 at a second circulation opening 26 adjacent the upper edge of the recess 20.

In operation of the processor shown in FIG. 1 processing solution under pressure is supplied to opening 24 from which it will spread upwardly and outwardly to produce an arcuate front of fluid which advances upward toward the outlet 26 to eventually fill the recess 20 and apply processing solution to the surface of sheet 22. As discussed in the Background Art section the disadvantage of this cell is that the configuration of the advancing fluid front results in central regions of the sheet being subjected to processing solution longer and at higher flow rates than the edge regions. This results in non uniform processing of the sheet.

Figure 2:
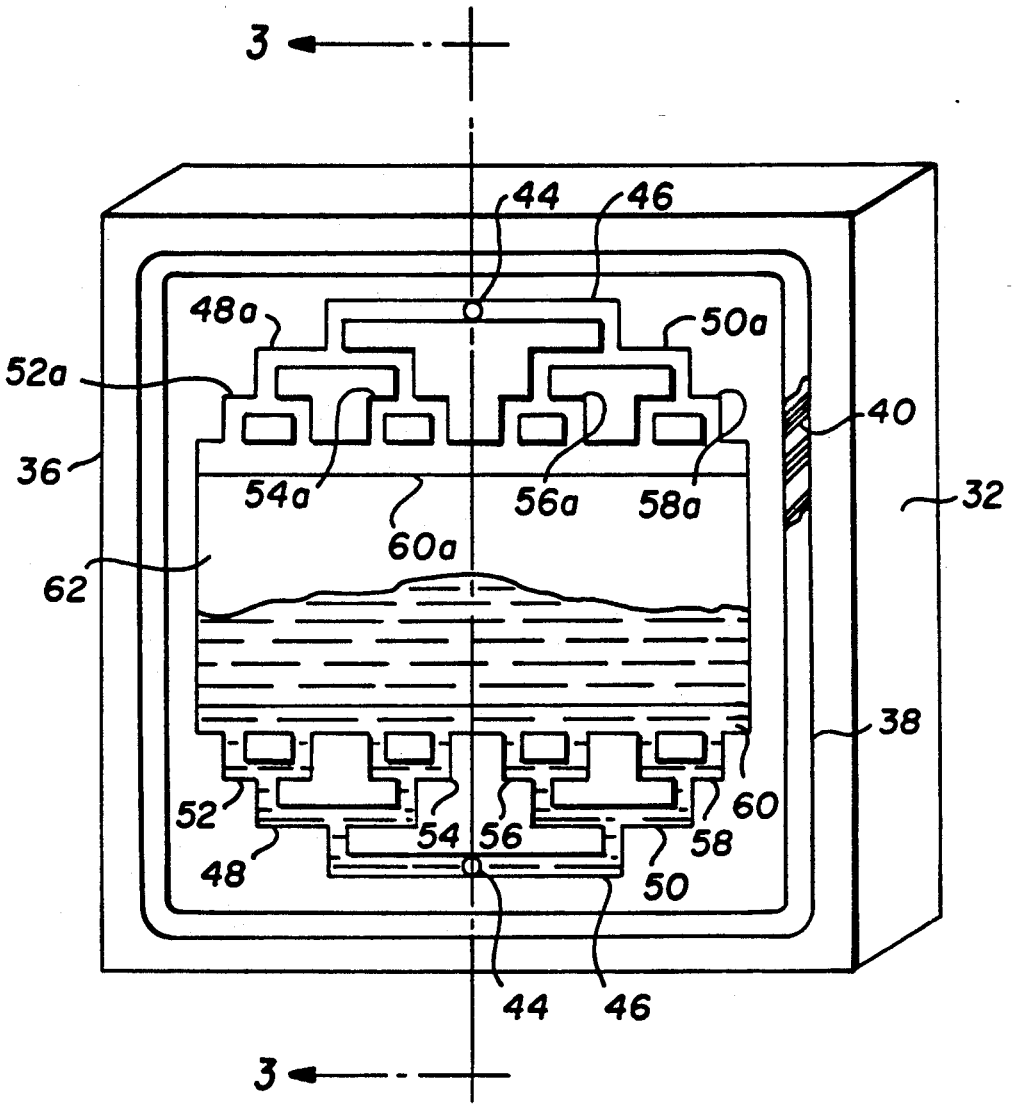
FIG. 2 is a schematic illustration of a cell processor in accordance with the invention for processing stationary sheets of light sensitive material.
Figure 3:
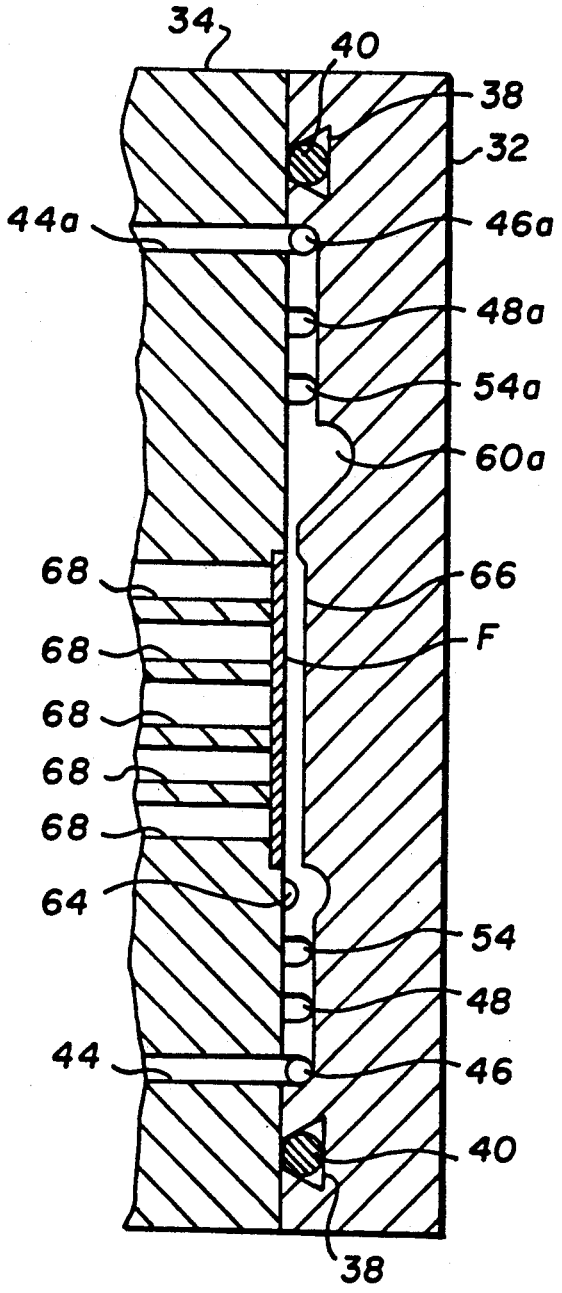
FIG. 3 is a section taken along the line 3—3 of FIG. 2.
Figure 4:
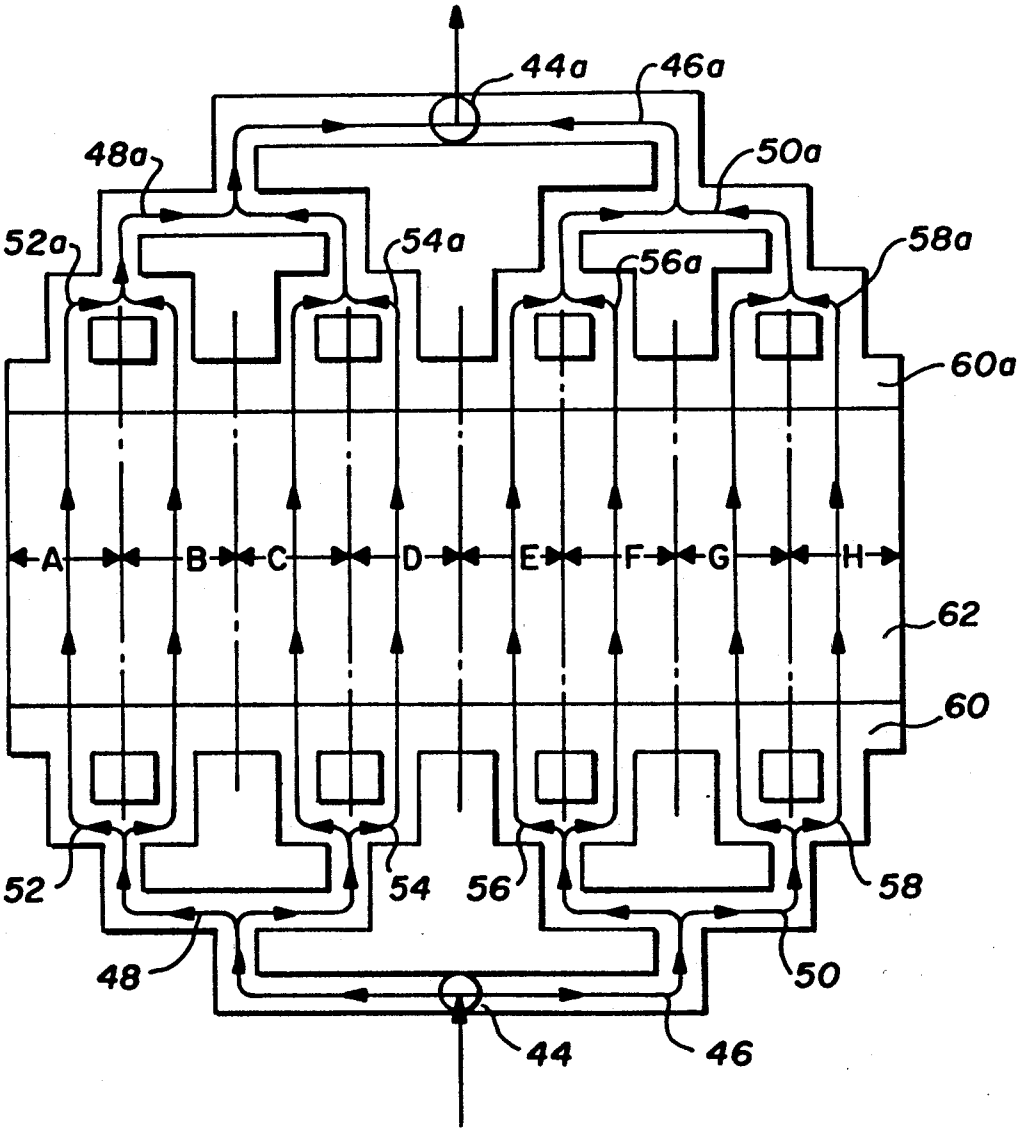
FIG. 4 is an enlarged schematic view illustrating in more detail the manifold system shown in FIGS. 2 and 3.

Referring to FIG. 2, 3, and 4 of the drawings a flow cell processor 30 in accordance with the invention comprises a two part housing having a rear part 32 and a front part 34 (FIG. 3). The rear part 32 has a face surface 36 provided with a triangular shaped recess 38 adjacent its periphery for receiving an O-ring seal 40. When the two parts are joined as shown in FIG. 3 the O-ring seal 40 will engage the flat surface of part 34 to effectively seal the interior of the housing.

The housing part 32 is provided with an inlet passage 44 for injecting processing fluid under pressure into the space between the housing parts 32 and 34. The opening 44 communicates with a whiffletree fluid distribution system. More specifically the opening 44 communicates with an elongated transverse fluid passage 46 the ends of which communicate with smaller transverse passages 48 and 50 respectively. The ends of passage 48 communicate with a pair of transverse passages 52 and 54 respectively, and the ends of passage 50 communicate with a pair of transverse passages 56 and 58 respectively. The ends of passages 52, 54, 56 and 58 communicate with a transverse distribution passage 60 which as described below has a length corresponding to the width of the sheet to be processed.

The passages 46, 48, 50, 52, 54, 56 and 58 and related connecting segments are connected in a whiffletree configuration to divide and subdivide the fluid flow from opening 44 in a system of passages so that fluid is supplied substantially simultaneously and at uniform pressure to a plurality of equally spaced locations of the transverse distribution passage 60. To achieve such uniformity the dimensions A, B, C, D, E, F, G and H indicated in FIG. 4 are preferably made equal to provide equal spacing between the whiffletree segments. This fluid distribution system will hereafter be referred to as a whiffletree fluid distribution system.

A generally rectangular recess 62 for receiving a film sheet F is provided in the face surface 64 of the housing part 34. The passage 60 has a length substantially equal to the width of the recess 62 and film sheet F and communicates with a rectangular recess 66 in the housing part 32 for injecting fluid into the recess 66 over the surface of a film sheet F as described below.

A similar whiffletree fluid distribution system is provided above the film recess 62 for evacuating processing solution from the recess 62. The upper whiffletree system has liquid passages similar to those below the recess 62 which are identified by like reference numerals with the suffix (a).

The film sheet F may be retained in a processing position within the recess 60 by vacuum means which include a plurality of substantially parallel passages 68 (FIG. 3) which extend from the bottom surface of the recess 62 for connection to a source of vacuum (not shown). Application of vacuum to passage 68 will draw the film sheet F into firm engagement with the bottom surface of recess 62 to securely hold the sheet in the position shown in FIG. 3.

In operation of the processor shown in FIGS. 2 and 3 processing fluid under pressure is supplied to the passage 44 from which the fluid will be evenly distributed by passages 46, 48, 50, 52, 54, 56 and 58 to the transverse fluid passage 60. The fluid in passage 60 will advance across the length of the film sheet F as indicated in FIG. 2. Because the fluid is evenly divided and distributed by the whiffletree system before it advances across the film, the profile of the advancing fluid front is straight instead of curved. With this arrangement the processing time for all areas of the film sheet will be substantially equal.

When the fluid reaches the upper end of the film sheet F it will be evacuated into evacuation passage 60*a* and flow through passages 52*a*, 54*a*, 56*a*, 58*a*, 48*a* and 50*a* to the discharge passage 44*a*. The whiffletree evacuation system uniformly removes fluid across the width of the film sheet F and contributes to the processing uniformity.

FIG. 4 depicts schematically with exaggerated dimensions the processor shown in FIGS. 2 and 3 to illustrate with more clarity the fluid distribution process and the advancing fluid front.

Figure 5:
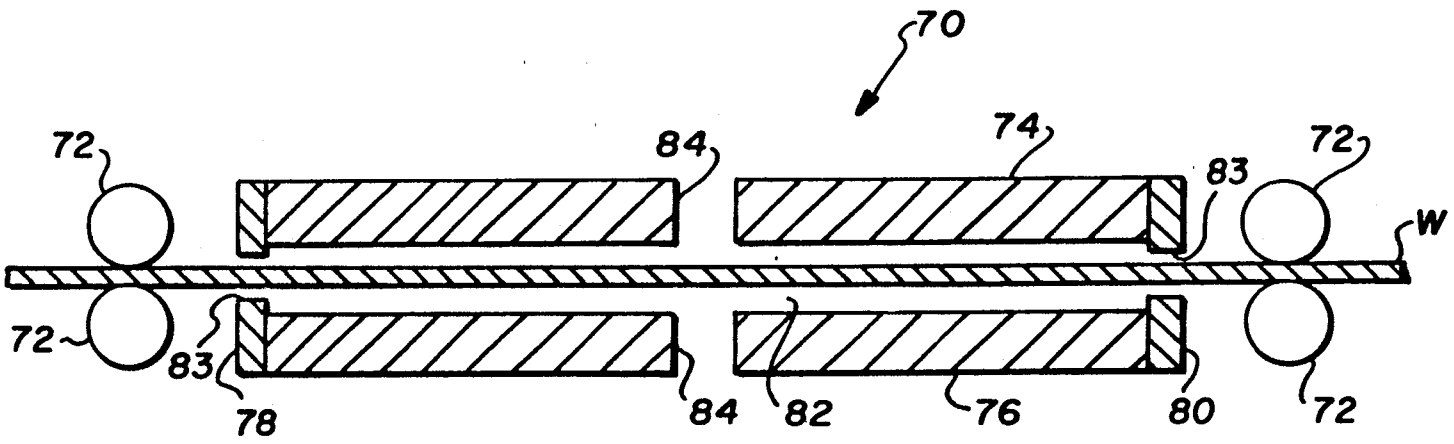
FIG. 5 is a sectional view showing a simple parallel plate processor.

FIGS. 5–8 of the drawings illustrate the application of the invention to a parallel plate processor. Referring to FIG. 5 of the drawings there is shown a basic parallel plate processor 70 for processing a web W transported therethrough by rollers 72. In general the processor 70 comprises a pair of parallel plates 74 and 76 supported in spaced relationship by end plates 78 and 80 to define a channel or recess 82 for movement of the web therebetween and to define fluid evacuation openings 83 for evacuating fluid from the channel. The plates 74 and 76 are provided with a pair of opposed fluid injection slits 84 which extend transversely of the web path to inject processing fluid under pressure into the channel 80 on opposite sides of the web. This basic parallel plate processor structure is more fully disclosed and described in copending Application Ser. No. 07/633,505 cross referenced above and incorporated herein by reference. As disclosed in Application Ser. No. 07/633,505 fluid is injected into the channel 82 via slits 84 on opposite sides of the web to support the same. Fluid will flow in opposite directions from the slits to be evacuated by openings 83 at opposite ends of the channel 82. The parameters of the system are selected such that the fluid will be evacuated when the chemical boundary layer at the film interface reaches a predetermined thickness so that the mass transfer rate of chemicals within the fluid exceeds the chemical mass transfer rate within the film.

Figure 6:
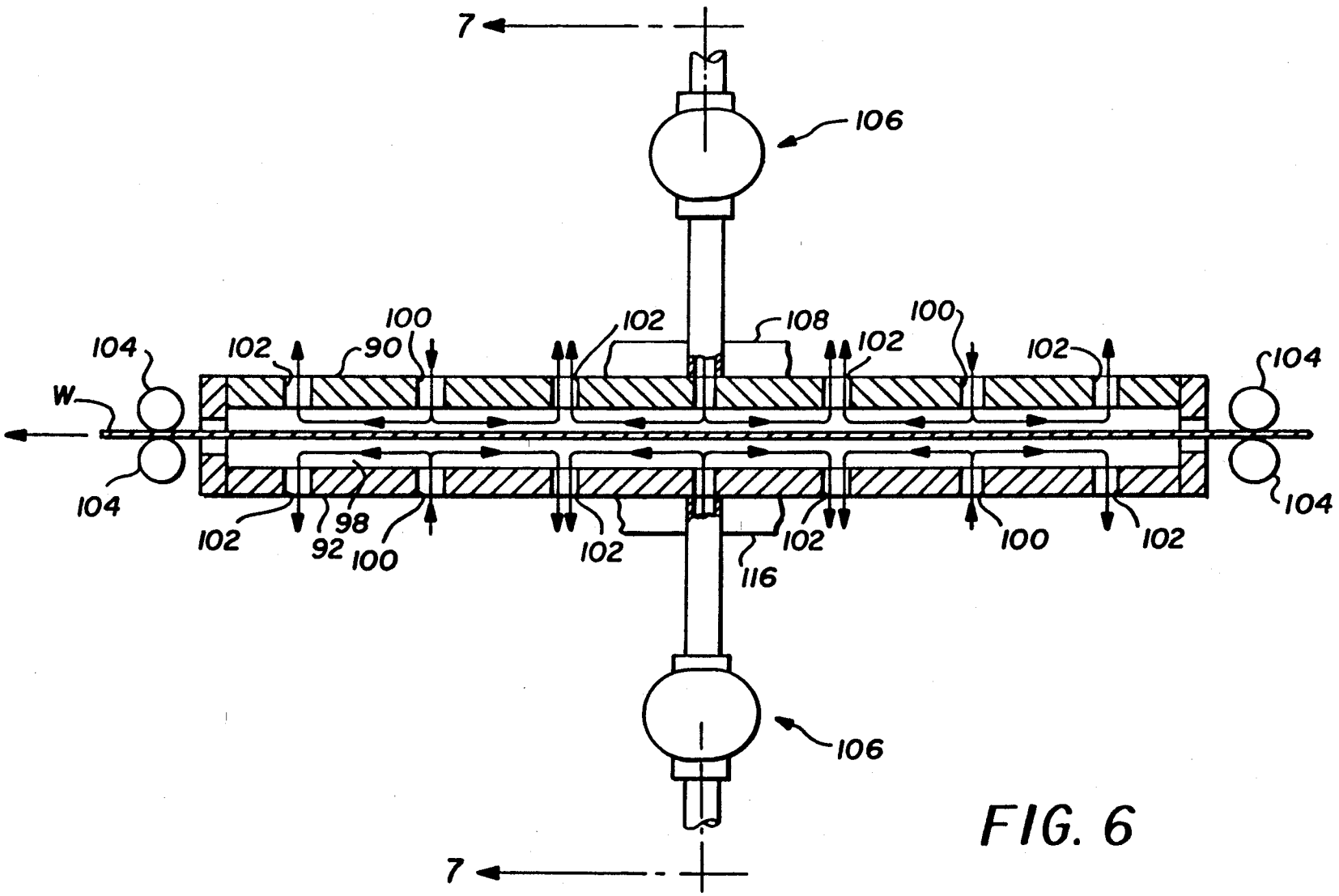
FIG. 6 is a sectional view showing a preferred form of a parallel plate processor having a plurality of injection and evacuation sites for processing moving webs of light sensitive material.

A preferred embodiment of a parallel plate processor is shown in FIG. 6. In this embodiment a pair of parallel plates 90 and 92 are supported in spaced relationship by end plates 94 and 96 to define a web channel or recess 98. The plates 90 and 92 are provided with a plurality of juxtaposed transverse fluid injection slits 100 and a plurality of juxtaposed transverse evacuation slits 102 along the length of the web channel. A web W is transported through the channel 98 by rollers 104. In the FIG. 6 embodiment the injection slits 100 and evacuation slits 102 are placed in an alternating pattern such that an injection slit 100 is located between two evacuation slits 102. When fluid under pressure is supplied to the injection slits fluid will flow in opposite directions from each injection slit 100 to the adjacent evacuation slits 102 where it will be evacuated, such flow pattern being indicated by the arrows in FIG. 6. As in the case of the FIG. 5 embodiment the injection slits are spaced from the evacuation slits by a distance such that the fluid is evacuated when its boundary layer reaches a predetermined thickness to maintain a chemical mass transfer rate from the fluid to the film that is greater than that in the film. This multi slit processor is also more fully disclosed and described in copending Application Ser. Nos. 07/633,505 and 07/633,521, and further description is deemed unnecessary.

Considering now the fluid supply systems for the parallel plate processors of FIGS. 5 and 6 if an injection slit 84 or 100 is supplied with fluid from a central opening the fluid leaving the slit will have an arcuate fluid front similar to the processing cell depicted in FIG. 1. This is because fluid will reach the central regions of the slit first and gradually spread to the end regions as the fluid moves from the center region into the web channel. Similarly if the evacuation slits are connected to a central opening the fluid will be evacuated from the central region first. These conditions can result in non-uniform processing as discussed above.

Figure 8:
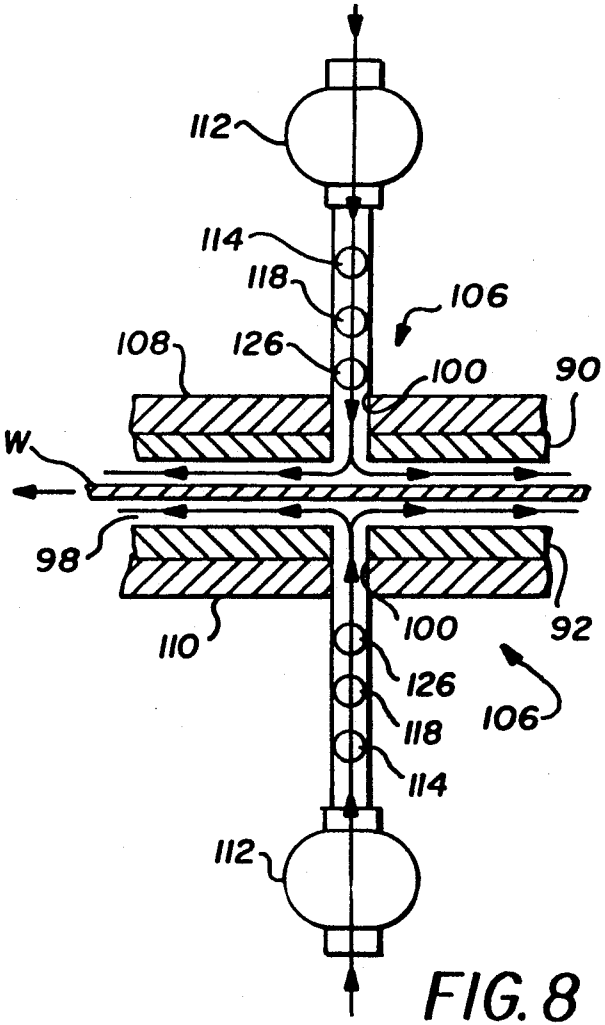
FIG. 8 is a section taken along the line 8—8 of FIG. 7.
Figure 7:
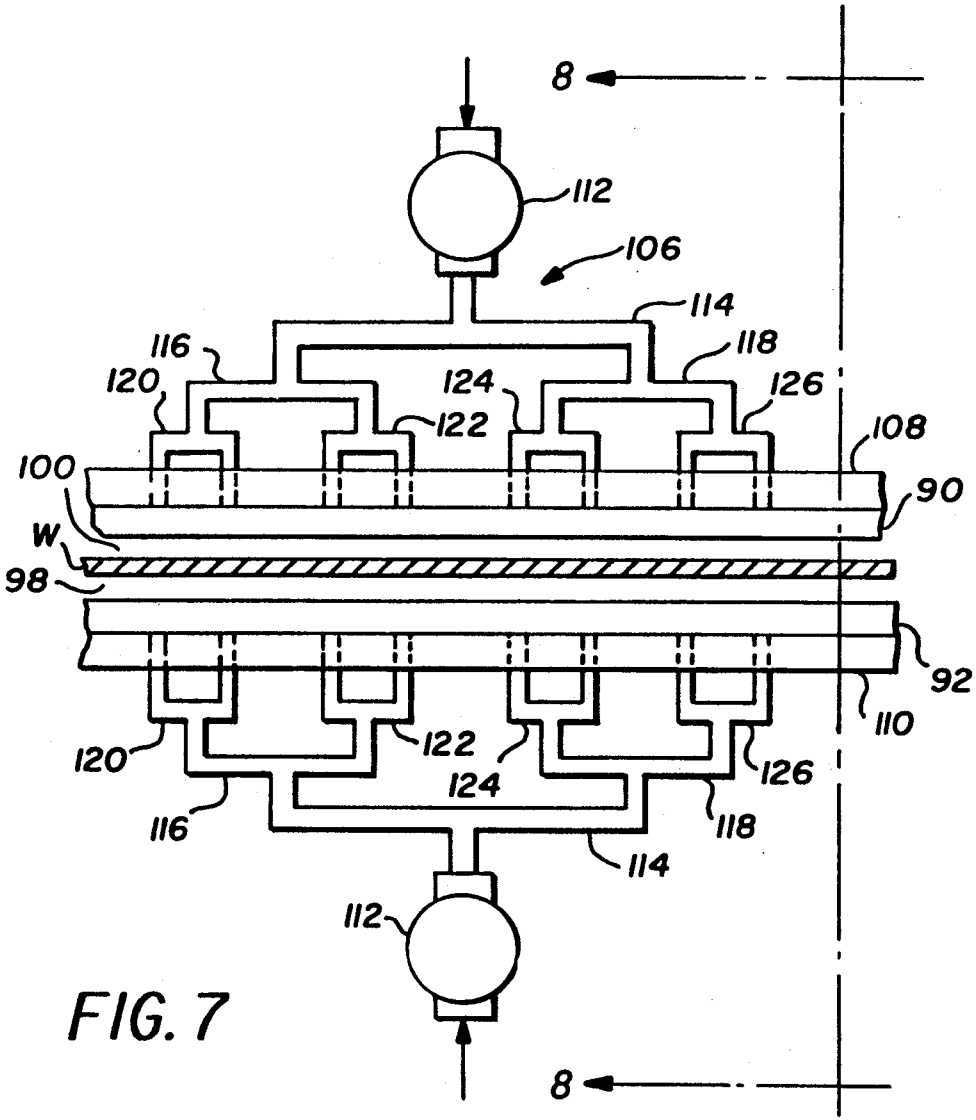
FIG. 7 is a cross section taken transversely of the film path of a parallel plate processor through one of the injection slits.

In accordance with the invention a whiffletree fluid distribution system similar to that shown in FIGS. 2 and 3 are used to achieve uniform fluid distribution over the length of the injection and evacuation slits of the type shown in FIGS. 5 and 6. Referring to FIGS. 6, 7 and 8 whiffletree distribution systems 106 are shown applied to a pair of juxtaposed injection slits 100 respectively. While systems 106 are shown in relation to a single injection site it will be apparent that a system 106 is preferably associated with each of the injection slits and each of the evacuation slits shown in FIG. 6 and with each of the injection slits shown in FIG. 5. Thus each injection slit and each evacuation slit would be provided with a whiffletree system as depicted in FIGS. 6 and 7.

Referring now in detail to FIGS. 7 and 8 of the drawings each fluid distribution system 106 comprises a pair support plates 108 and 110 attached to plates 90 and 92 respectively. The fluid distribution systems 106 are supported by plates 108 and 110 as indicated schematically in FIGS. 7 and 8. Each system includes a pump 112 for supplying fluid under pressure to a main conduit 114 the ends of which communicate with a pair of parallel branch conduits 116 and 118. The ends of branch conduit 116 are connected to the central regions respectively of a pair of branch conduits 120 and 122 which communicate with the left half of the injection slit 100. Similarly the branch conduit 118 communicates with the central regions respectively of a pair of branch conduits 124 and 126 the ends of which communicate with the right side of slit 100 as viewed in FIG. 7. The whiffletree system depicted thus distributes the flow evenly over the length of slit 100 to produce a fluid front which reaches the web W with a straight leading edge rather than a curved profile as discussed in connection with FIGS. 2 and 3. Similarly each whiffletree evacuation system will evacuate fluid uniformly over the length of an evacuation slit. The apparatus will thus produce injection and evacuation fluid profiles which are uniform to provide uniform processing.

It will be apparent that the whiffletree distribution system shown schematically in FIGS. 6, 7 and 8 may be structurally realized by using two part housings similar to FIGS. 2 and 3 which have mating surfaces provided with face groves to define the described conduits. Such modification is well within the capability of one skilled in the art and further description is deemed unnecessary.

Those skilled in the art to which the invention relates will appreciate that various substitutions and modifications can be made to the described embodiments without departing from the spirit and scope of the invention as defined by the appended claims.

We claim:

1. Apparatus for treating a web with treatment fluid comprising:

means having a recess for receiving the web;

a fluid distribution system comprising a series of passages for dividing and subdividing the treatment fluid to simultaneously supply treatment fluid to the recess at a plurality of locations across the recess to uniformly treat the web with the treatment fluid.

2. Apparatus as claimed in claim 1 wherein said passages are connected in a whiffletree configuration.

3. Apparatus as claimed in claim 2 wherein the web is a generally rectangular sheet and said recess comprises a generally rectangular recess for receiving the sheet.

4. Apparatus as claimed in claim 1 wherein said means comprises a pair of parallel surfaces defining said recess therebetween and having at least one elongated opening extending transversely of said recess for injecting fluid into said channel and wherein said fluid distribution system supplies fluid to the recess through said opening.

5. Apparatus as claimed in claim 4 wherein said passages of said fluid distribution system are connected in a whiffletree configuration.

6. A processor for treating a light sensitive sheet with processing liquid, said processor comprising:

housing means defining a recess for receiving a sheet to be processed;

fluid entrance and exit passages having predetermined lengths extending transversely of the recess at opposite ends thereof respectively;

a first whiffletree fluid distribution system for supplying liquid under pressure to said entrance passage to substantially uniformly fill the length of said entrance passage with liquid and establish a liquid front for movement across the sheet to said exit passage; and a second whiffletree fluid distribution system for evacuating liquid from said exit passage uniformly over the length of said exit passage.

7. A processor as claimed in claim 6 wherein said housing means comprises a two part housing having mating face surfaces, said recess, said entrance and exit passages, and said fluid distribution systems comprise cavities formed in at least one of said face surfaces.

8. A processor as claimed in claim 7 further including vacuum means for applying vacuum to the sheet to retain it in said recess.

9. In a processor for treating a light sensitive web with processing liquid, said processor comprising:

first means having a recess for receiving a web, said means having at least one elongated fluid injection opening extending transversely of said recess for injecting the processing liquid into said recess across the width of the web; and second means associated with said opening for substantially simultaneously supplying the processing liquid to a plurality of locations along said opening to uniformly fill said opening with liquid.

10. A processor as claimed in claim 9 wherein said second means comprises a whiffletree fluid distribution system.

11. A processor as claimed in claim 9 where said first means comprises a pair of substantially parallel plates defining said recess therebetween.

12. A processor as claimed in claim 11 wherein said surfaces have at least one pair of said fluid injection openings on opposite sides of the web respectively in juxtaposed relationship, said second means being associated with said injection openings.

13. A processor as claimed in claim 12 wherein said first means further include at least one pair of elongated evacuation openings extending transversely of the recess on opposite sides of the web respectively in juxtaposed relationship for evacuating fluid from said recess.

14. A processor as claimed in claim 13 further including third means associated with each of said evacuation openings for uniformly evacuating processing liquid from said evacuation openings.

15. A processor as claimed in claim 14 wherein said second and third means comprises whiffletree fluid distribution systems.

16. Apparatus for treating a web with treatment fluid comprising:

means having a recess for receiving the web, said means having at least one elongated fluid injection opening extending transversely of said recess for injecting treatment fluid into said recess across the width of the web; and fluid supply means associated with said opening for substantially simultaneously supplying treatment fluid to a plurality of locations along said opening to uniformly fill said opening and uniformly treat the web with treatment fluid.

17. Apparatus as claimed in claim 16 when said fluid supply means comprises a whiffletree fluid distribution means.

18. Apparatus as claimed in claim 17 wherein said whiffletree fluid distribution means comprises a series of passages connected to said opening for dividing and subdividing the treatment fluid to substantially simultaneously supply treatment fluid to the opening at a plurality of locations along said opening.

19. Apparatus as claimed in claim 17 further including fluid evacuation means for evacuating treatment fluid from the recess at a plurality of locations across the recess.

20. Apparatus as claimed in claim 19 wherein said fluid evacuation means comprises a whiffletree fluid distribution means.

21. Apparatus as claimed in claim 20 wherein said second fluid distribution means comprises a second series of passages connected to said recess.

* * * * *

UNITED STATES PATENT AND TRADEMARK OFFICE

CERTIFICATE OF CORRECTION

PATENT NO. : 5,289,224

DATED : February 22, 1994

INVENTOR(S) : Mark J. Devaney, et al.

It is certified that error appears in the above-indentified patent and that said Letters Patent is hereby corrected as shown below:

Column 6, Line 62
Delete "plates" and insert --surfaces-

Column 7, Line 2
Delete "include" and insert --includes

Column 8, Line 17
After "comprises a" insert --second--

Signed and Sealed this

Twentieth Day of September, 1994

Bruce Lehman

*Attest:*

BRUCE LEHMAN

*Attesting Officer*

*Commissioner of Patents and Trademarks*